United States Patent [19]

Peyrot

[11] Patent Number: 4,757,612

[45] Date of Patent: Jul. 19, 1988

[54] FIXED-BLADE KNIFE WITH RETRACTABLE BLADE COVER

[75] Inventor: Jean-Claude Peyrot, Bordeaux, France

[73] Assignee: Preposreve S.A.R.L., France

[21] Appl. No.: 14,215

[22] Filed: Feb. 5, 1987

Related U.S. Application Data

[63] Continuation of Ser. No. 714,447, Mar. 21, 1985, abandoned.

[51] Int. Cl.[4] ..... B26B 3/06

[52] U.S. Cl. ..... 30/151; 30/286

[58] Field of Search ..... 30/162, 151, 286, 2, 30/164

[56] References Cited

U.S. PATENT DOCUMENTS

| | | | |
|---|---|---|---|
| 1,385,294 | 7/1921 | Zorn | 30/136.5 |
| 2,380,787 | 7/1945 | Pierce et al. | 30/293 X |
| 2,597,540 | 5/1952 | Smith | 30/295 X |
| 3,943,627 | 3/1976 | Stanley, Jr. | 30/162 |
| 4,393,587 | 7/1983 | Kloosterman | 30/293 X |
| 4,523,379 | 6/1985 | Osterhout et al. | 30/286 X |

FOREIGN PATENT DOCUMENTS

| | | |
|---|---|---|
| 1264288 | 3/1968 | Fed. Rep. of Germany . |
| 2623490 | 12/1977 | Fed. Rep. of Germany . |
| 2350182 | 5/1977 | France . |

*Primary Examiner*—E. R. Kazenske
*Assistant Examiner*—Willmon Fridie, Jr.
*Attorney, Agent, or Firm*—Robert J. Koch

[57] ABSTRACT

A cutter type knife comprises a hollow handle, a housing in said handle adapted to receive a removable blade fixed in position relative to said handle and projecting at least partly from one end of said handle. A blade cover is slidably disposed within said handle to be movable axially between a first position in which it is retracted into said handle and a second position in which it is adapted to surround or cover the part of said blade projecting from said handle. Means are provided for moving said blade cover between said first and second positions consisting of a trigger pivoted to said handle and a transmission mechanism is adapted to convert rotation of said trigger into axial displacement of said blade cover within said handle, whereby when said trigger is depressed said blade cover is moved to said first position.

6 Claims, 2 Drawing Sheets

FIXED-BLADE KNIFE WITH RETRACTABLE BLADE COVER

This application is a continuation of application Ser. No. 714,447, filed Mar. 21, 1985 now abandoned.

BACKGROUND OF THE INVENTION

The present invention relates to a fixed-blade knife of the cutter type fitted with a retractable blade cover.

An object of the invention is to improve this type of knife, the fixed blade of which projects from the handle at all times, whether in use or not, from the safety point of view by proposing means for completely covering the blade when the knife is not in use.

SUMMARY OF THE INVENTION

To this end, the invention consists in a knife comprising a hollow handle, a housing in said handle adapted to receive a removable blade fixed in position relative to said handle and projecting at least partly from one end of said handle, a blade cover slidably disposed within said handle to be movable axially between a first position in which it is retracted into said handle and a second position in which it is adapted to surround or cover the part of said blade projecting from said handle, and means for moving said blade cover between said first and second positions consisting of a trigger pivoted to said handle and a transmission mechanism adapted to convert rotation of said trigger into axial displacement of said blade cover within said handle, whereby when said trigger is depressed said blade cover is moved to said first position.

A knife of this kind is absolutely safe since the blade is completely covered at all times except when, on gripping the handle, pressure is exerted on the trigger by the palm or a finger to expose the blade.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
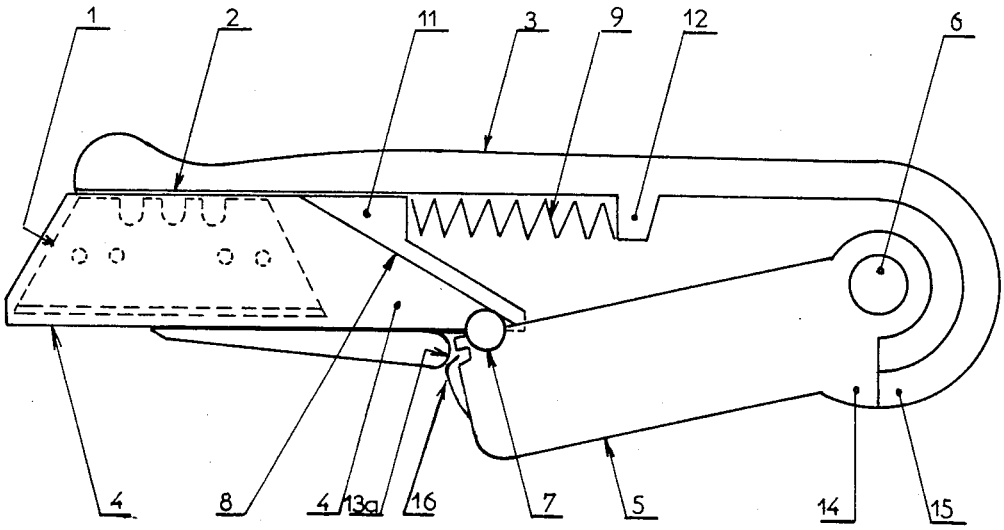
FIG. 1 is a schematic representation in vertical cross-section of a knife in accordance with the invention in the non-operative position.
Figure 2:
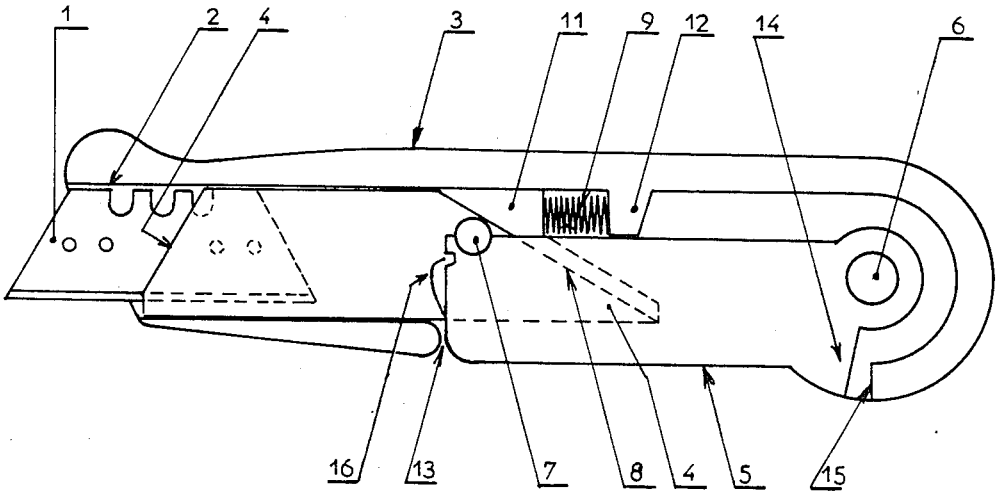
FIG. 2 shows the knife of FIG. 1 in the operative position.

FIGS. 1 and 2 show a cutter of the type with a fixed blade 1 accommodated in the known manner in an axial housing 2 formed in the handle 3.

The body of the handle 3 is generally made in two parts fitting together on a substantially median plane.

The blade 1 is removable, although not mobile relative to the handle 3, and is retained in its housing by locating studs, in the usual manner.

In accordance with the invention, the knife is equipped with a blade protector or cover 4 which is retractable within the handle 3.

This cover 4 consists of a U-shaped metal or plastics material case or sheath which fits over the edge of the blade 1 and is movable in translation parallel to the edge of the blade between a position in which it is completely retracted into the handle (FIG. 2) and a position (FIG. 1) in which it projects sufficiently to completely cover the part of the blade 1 projecting from the handle.

The end of the cover 4 is shaped to correspond to the shape of the blade 1.

The parallel flanks of the cover 4 are a few tenths of a millimeter from the blade, the cover being guided by the walls of the housing 2 accommodating the blade. This housing extends over the entire length of the handle 3 and accommodates the means controlling movement of the cover.

In the embodiment shown these means consist of a lever or trigger 5 pivoted to the rear of the handle 3 on a pivot 6 perpendicular to the plane of the blade 1.

The end of the trigger 5 is provided, on the inside, with a cylindrical stud 7 cooperating with an inclined surface rib 8 fastened to the cover 4 at its inside end.

The trigger 5 is offset laterally relative to the cover 4 so that the two parts can move parallel to one another without interfering with one another, the stud projecting laterally from the trigger 5 so as to be able to slide along the inclined groove 8, also disposed laterally of the cover 4 in the direction towards the trigger 5.

A helical spring 9 is disposed parallel to the axis of translation of the cover 4 between an abutment 11 at the rear end of the latter and an abutment 12 fastened to the handle 3. This spring 9 is slightly compressed in the position in which the cover 1 projects to the maximum extent (FIG. 1) and is compressed to the maximum extent in the position in which the cover 4 is retracted to the maximum extent inside the handle (FIG. 2).

In the position in which the trigger 5 is totally released (FIG. 1), the trigger projects significantly beyond the handle 3 through an aperture 13 provided for this purpose in the wall of the handle. A projection 14 at the rear of the trigger 5 cooperating with a rim on the handle acts as a stop member. In this position of the stud 7 is substantially aligned with the end rib of the inclined surface 8.

In the position (FIG. 2) in which the trigger 5 is fully depressed, the stud 7 has slid over almost all the length of said inclined surface 8 and the trigger 5 comes into contact with the abutment 11, the outside edge of the trigger being aligned with the corresponding edge of the handle 3.

The device shown further comprises a leaf spring 16 for elastically latching the trigger 5 in the unoperated position (FIG. 1).

This leaf spring 16 is fixed to the end of the trigger 5 and cooperates with the facing rim 13*a* of the opening through which the trigger passes.

Light force must be applied to the trigger 5 to overcome the resistance of the spring 16 before commencement of the retraction of the cover 4 by pressure of the stud 7 on the inclined surface 8 which is constrained to move towards the rear of the handle.

In this way there is provided a knife which is totally safe when not in use, or more precisely when no pressure is exerted on the trigger 5.

The trigger is operated by the palm or a finger of the hand holding the knife, without difficulty or fatigue. As soon as pressure on the trigger 5 is released, which evidently is the case whenever the knife is not in use, the spring 9 automatically returns the cover 4 to the position in which the blade 1 is fully covered.

In this way the knife may be safely transported or placed in a pocket.

It is also possible to provide an auxiliary device for latching the trigger 5 in the depressed position as and when required, the trigger being released when the knife is finished with.

It will be understood that other means may be employed to command translation of the cover 4 between its two end positions. Thus the trigger (either as shown or differently arranged) could comprise in line with its pivot teeth meshing with a rack parallel to the translation axis of the cover 4, fastened to the latter and slidably disposed within the handle 3.

Figure 3:
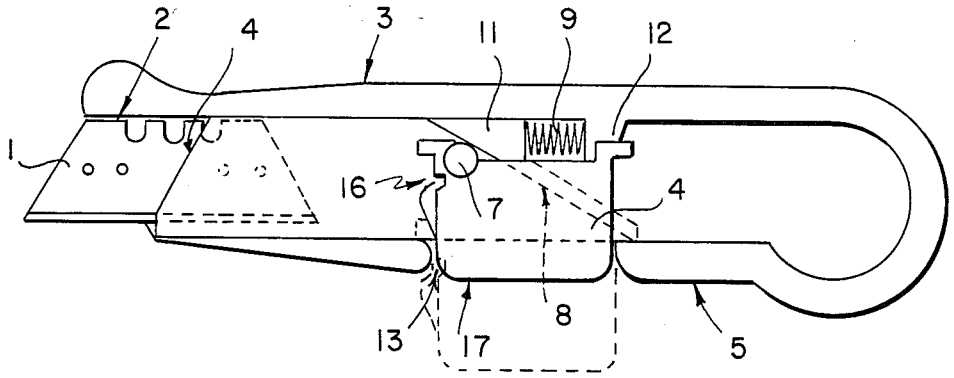
FIG. 3 shows a fixed-blade knife in the operative position with a push-button actuator.

The trigger 5 could equally well be replaced by a pushbutton 17 as shown in FIG. 3 and communicating its movement to the cover 4 by an appropriate transmission mechanism which could be implemented in any of a large number of ways such as said stud 7 and incline surface 8.

Finally, the shape and dimensions of the cover may vary to a very great extent, in particular according to the type of blade.

I claim:

1. Knife comprising a hollow handle, a housing in said handle adapted to receive a removable blade fixed in position relative to said handle and projecting at least partly from one end of said handle, a blade cover slidably disposed within said handle to be movable axially between a first position in which it is retracted into said handle and a second position in which it is adapted to surround or cover the part of said blade projecting from said handle, and means for moving said blade cover between said first and second positions exhibiting an actuator pivoted to said handle and a transmission mechanism adapted to convert rotation of said actuator into axial displacement of said blade cover within said handle, whereby when said actuator is depressed said blade cover is moved to said first position.

2. Knife according to claim 1, wherein said actuator is a lever pivoted to said handle and said transmission mechanism comprises a stud on said lever and an inclined surface on said blade cover with which said stud cooperates.

3. Knife according to claim 1, further comprising spring-loaded means adapted to latch said actuator in a position in which said blade cover surrounds or covers said blade and to be overridden by initially greater pressure on said actuator.

4. Knife comprising a hollow handle, a housing in said handle adapted to receive a removable blade fixed in position relative to said handle and projecting at least partly from one end of said handle, a spring biased blade cover slidably disposed within said handle to be movable axially between a first position in which it is retracted into said handle and a second position in which it is adapted to surround or cover the part of said blade projecting from said handle, and means for moving said blade cover, between said first and second positions, exhibiting a radially displaceable actuator mounted on said handle and a transmission mechanism adapted to convert radial motion of said actuator into axial displacement of said blade cover within said handle, whereby when said actuator is depressed said blade cover is moved to said first position.

5. Knife according to claim 4, wherein said actuator is a push-button and said transmission mechanism comprises a stud on said push-button and an inclined surface on said blade cover with which said stud cooperates.

6. Knife according to claim 5, further comprising spring-loaded means adapted to latch said actuator in a position in which said blade cover surrounds or covers said blade and to be overridden by initially greater pressure on said actuator.

* * * * *